US005996200A

United States Patent [19]

Rosenthal et al.

[11] Patent Number: 5,996,200

[45] **Date of Patent: *Dec. 7, 1999**

[54] DESCALING DEVICE AND METHOD

[75] Inventors: Dieter Rosenthal, Niederfischbach; Joachim Pfeiffer, Hilchenbach; Horst Grafe, Hilchenbach; Max Münker, Hilchenbach; Berthold Hild, Burbach, all of Germany

[73] Assignee: SMS Schloemann-Siemag Aktiengesellschaft, Düsseldorf, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/638,315

[22] Filed: Apr. 26, 1996

Related U.S. Application Data

[63] Continuation-in-part of application No. 08/301,227, Sep. 6, 1994, abandoned.

[30] Foreign Application Priority Data

Sep. 9, 1993 [DE] Germany ..... 43 30 519

[51] Int. Cl.[6] ..... B21B 45/04

[52] U.S. Cl. ..... 29/81.08; 72/39

[58] Field of Search ..... 29/81.06, 81.08; 72/39, 40; 134/41; 137/567

[56] References Cited

U.S. PATENT DOCUMENTS

| | | | |
|---|---|---|---|
| 3,782,887 | 1/1974 | Wolhrab | 137/567 |
| 4,334,308 | 6/1982 | Shimada et al. | 72/39 |
| 4,475,369 | 10/1984 | Matsuda et al. | 72/39 X |
| 5,502,881 | 4/1996 | Gaydoul | 29/81.08 |

FOREIGN PATENT DOCUMENTS 5970418 4/1984 Japan .

OTHER PUBLICATIONS

Trauschold, R., *Steel*, "Descaling Steel", vol. 113, Sep. 13, 1943, pp. 112, 113, 116.

*Primary Examiner*—David P. Bryant
*Attorney, Agent, or Firm*—Friedrich Kueffner

[57] ABSTRACT

A descaling device for slabs or strips in hot rolling mills includes nozzles fed by a pressurized water piston pump for directing water jets against the slab or strip for removing scale adhering to the surface of the slab or strip. At least one additional pressurized water piston pump is provided, wherein the piston pumps are connected in parallel and the pumps can be switched on and off separately. A second row of nozzles may be arranged in front of the nozzles at a distance which ensures that the water jets do not influence each other. The water pressure of the water supplied to the second row of nozzles is preferably lower than the water pressure supplied to the first row of nozzles.

7 Claims, 3 Drawing Sheets

DESCALING DEVICE AND METHOD

This is a continuation-in-part of prior application Ser. No. 08/301,227, filed on Sep. 6, 1994, now abandoned.

BACKGROUND OF THE INVENTION

1. Field of the Invention

The present invention relates to a descaling device for slabs or strips in hot rolling mills. The descaling device includes a plurality of nozzles which are fed by a pressurized water piston pump and produce jets for the removal of scale adhering to the surfaces of the slabs or strips.

2. Description of the Related Art

When slabs or strips are descaled prior to hot rolling, a distinction is made between primary scale and secondary scale. Secondary scale is formed on already rolled material when the rolled material is heated to rolling temperature or is kept at rolling temperature. Primary scale is scale which is formed on the material after casting of slabs or strips. Primary scale adheres much more firmly to the material than secondary scale. If the cast material is continued to be heated for a longer period of time, even more scale is formed which adheres even more firmly to the material. In addition, the adherence of the scale strongly depends on the materials being used.

Slabs or strips to which secondary scale adheres are descaled by means of pressurized water which is sprayed through nozzles onto the surface of the slab or strip. As a rule, the pressurized water is pumped by centrifugal pumps which work at maximum pressures of 300 bars. The resulting specific impact force and the quantity of water determine the descaling effect. Satisfactory results are achieved when secondary scale is removed by means of this arrangement.

However, slabs and strips are increasingly cast and hot rolled from the casting heat, wherein an equalizing furnace may be interposed. Therefore, it is necessary to remove primary scale which adheres to the material. The descaling effect depends on the quantity of water and the pressure which, among other things, determine the impact force.

When steel is continuously cast and subsequently hot rolled from the casting temperature, the entry speed at the first hot rolling stand is approximately ⅓ of the speed of the already rolled material. When the quantity of water per unit of time remains the same, these speed differences cause the cast material to be cooled, as compared to the pre-rolled material, to such an extent that the temperature of the material drops below the minimum temperature for the hot rolling procedure. Even if the quantity of water per unit of time is converted to the slower entry speed, an increase of the quantity of water is hardly possible in cast materials, because the material would be cooled more strongly because of the slower entry speed and an increase of the quantity of water would result in excessively strong cooling.

This means that the impact force of the water can only be increased by increasing the pressure. Since this requires pressures of up to 600 bars, the centrifugal pumps have to be replaced by piston pumps. However, it was found that the descaling device is subjected to substantial wear at such high pressures.

SUMMARY OF THE INVENTION

Therefore, it is the primary object of the present invention to further develop a descaling device to be used also for primary scale, such that the pressure can be adapted to the respective requirements and, thus, the wear and the costs for the descaling process are reduced.

A partial solution for meeting this object would be to use a piston pump whose speed and, thus, output are adjustable. However, a feeding pump which is to be adjustable over a range of zero to approximately 600 bars, is very voluminous and expensive, so that the wear but not the costs could be reduced.

In accordance with the present invention, at least one additional pressurized water piston pump is provided, wherein the piston pumps are connected in parallel and wherein the pumps can be separately switched on and off.

Specifically, the invention provides producing a flow of pressurized water having a pressure of between 300 and 600 bars by at least two pressurized water piston pumps which are connected in parallel and include means for separately switching on and off the pressurized water against the slabs or strips.

Contrary to centrifugal pumps, piston pumps are capable of pumping an almost constant volumetric flow independently of pressure, as illustrated in FIG. 1 which is a diagram showing the P/Q behavior of a piston pump, wherein P is the water pressure and Q is the volumetric flow. However, because of the resistance of nozzles and pipes of a descaling plant, the dependence of the pressure on the volumetric flow is actually a square function, as illustrated by the nozzle resistance characteristic of FIG. 2.

Accordingly, when the number of nozzles and the size of the nozzle openings are not changed, the resistance characteristic of a descaling plant corresponds to a determined square function. Consequently, an increase of the pressure at the nozzles can only be made on the line of the square function; in other words, when the pressure is increased, an increase of the flow must also be accepted. Thus, by switching the piston pumps on and off, it is possible to increase or decrease the pressure by changing the total volumetric flow and, consequently, to adjust the effective impact force of the water on the slab or strip, as illustrated in FIG. 3.

In accordance with an advantageous feature, the volumetric flow through at least one of the piston pumps is adjustable. This makes it possible to adjust any point of intersection on the resistance characteristic, so that an even better pressure/volumetric flow ratio can be realized.

In accordance with another feature of the present invention, the piston pumps are essentially identical, so that the manufacture and arrangement of piston pumps becomes less expensive and the number of piston pumps which have to be kept in stock is reduced.

When the resistance characteristic is changed by changing the number of nozzles or by changing the opening cross-section of the nozzles, additional pressure/volumetric flow ratios can be adjusted in conjunction with the piston pumps, wherein, even when the changes in volumetric flow are small, a steeper resistance characteristic results in large pressure changes, while, if the resistance characteristic is less steep, greater volumetric flow changes are required for achieving substantial pressure changes.

In accordance with another development of the present invention, a second row of nozzles is provided. This makes it even better possible to adjust the pressure of the descaling device and, thus, the descaling effect, to the existing requirements. If two rows of nozzles are provided, the first row of nozzles produces a descaling effect and the second row of nozzles completely descales the material, wherein the two rows of nozzles can operate at a pressure which is lower than the pressure used in descaling devices having only one row of nozzles. In this regard, it is even conceivable to use descaling plants in which the first row of nozzles is composed of centrifugal pumps and only the second row of nozzles is formed by piston pumps. In this case, the rows of nozzles must be separated from each other, for example, by mechanical or pneumatic locks or simply by providing an appropriate spacing between the rows of nozzles, so that the pressurized water jets and the water remaining on the material being descaled do not negatively affect each other.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
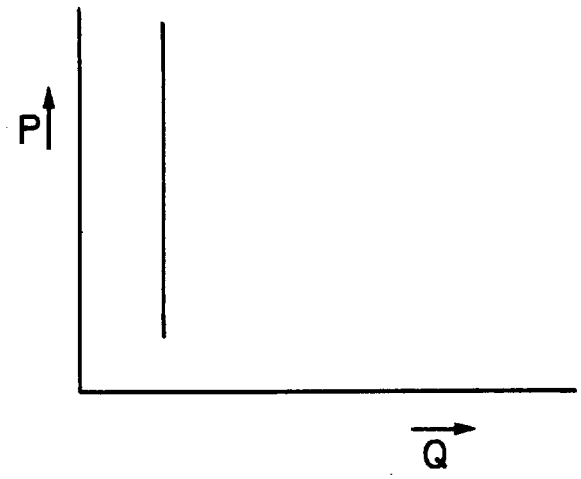
FIG. 1 is a diagram showing the P/Q ratio of piston pumps.
Figure 2:
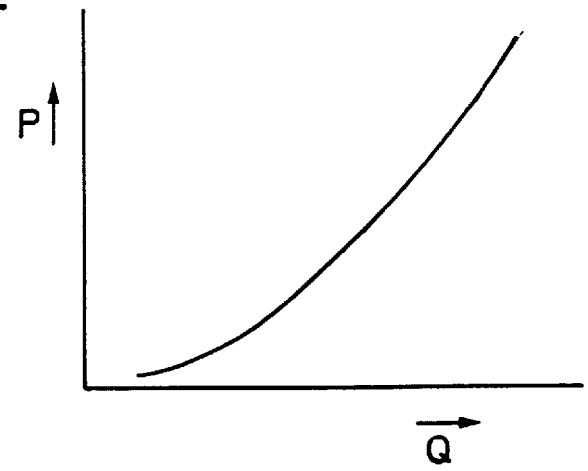
FIG. 2 is a diagram showing a nozzle resistance characteristic.
Figure 3:
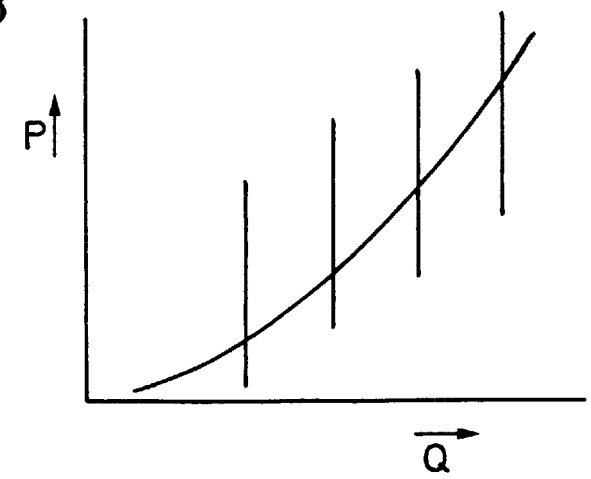
FIG. 3 is a diagram showing the adjustability of the pressure of the system when several piston pumps are used.

FIGS. 1–3 of the drawing have been discussed in detail hereinabove.

Figure 4:
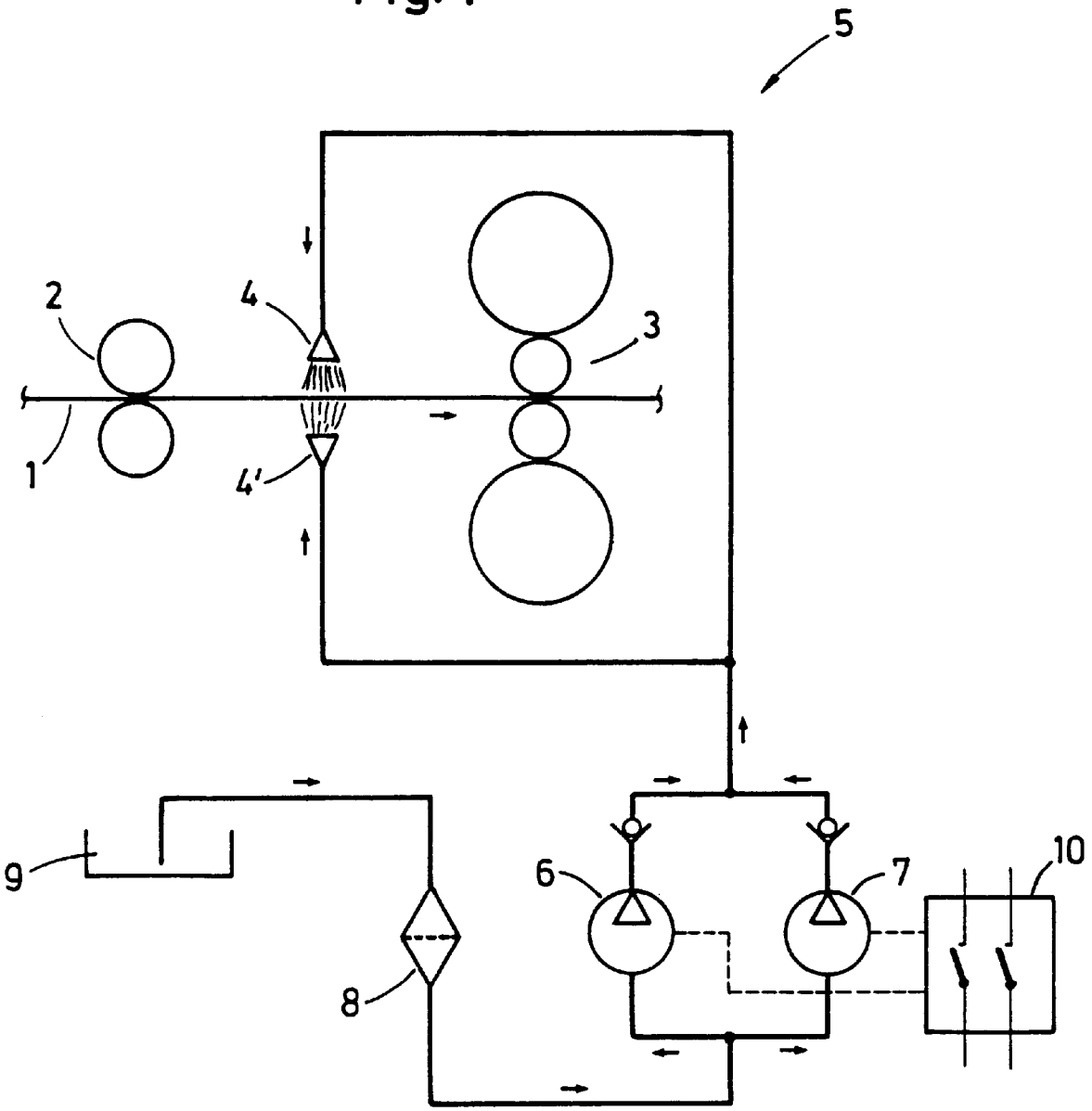
FIG. 4 is a schematic illustration of a descaling device according to the present invention.

FIG. 4 of the drawing schematically shows cast material to be rolled, for example, a slab 1. Nozzles 4, 4' of a descaling device 5 are arranged in the area of the slab 1 between a driver 2 and a first stand 3 of a hot rolling train. The nozzles 4, 4' are connected to two piston pumps 6, 7 which remove water from a tank 9 through a filter 8 and pump the water to the nozzles 4, 4'. The piston pumps 6, 7 are separately controllable by means of a schematically illustrated control unit 10.

Figure 5:
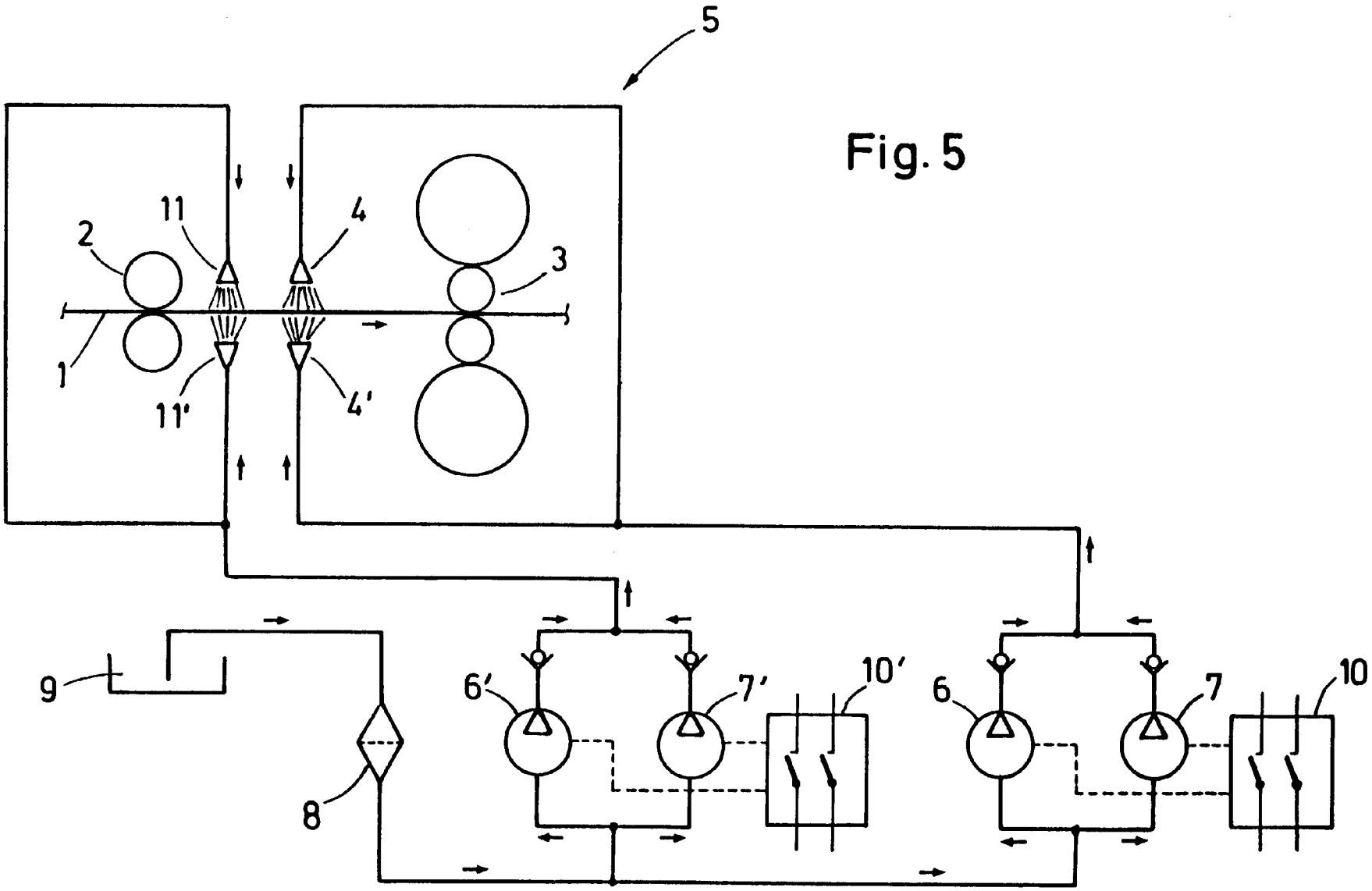
FIG. 5 is a schematic illustration of another descaling device according to the present invention with two rows of nozzles.

FIG. 5 of the drawing shows a descaling device which, compared to the descaling device according to FIG. 4, has additional nozzles 11, 11' which are connected to the filter 8 through two piston pumps 6', 7'. The piston pumps 6', 7' are separately controllable by means of a schematically illustrated control unit 10'.

The invention is not limited by the embodiments described above which are presented as examples only but can be modified in various ways within the scope of protection defined by the appended patent claims.

We claim:

1. A descaling device for removing primary scale from slabs or strips in hot rolling mills, the descaling device comprising a plurality of nozzles for directing water jets against the slabs or strips, a pressurized water piston pump for feeding pressurized water to the nozzles, at least one additional pressurized water piston pump for feeding pressurized water to the nozzles, wherein the pressurized water piston pumps are connected in parallel and are configured to produce a combined pressure of between 300 and 600 bars, further comprising means for separately switching on and off the pressurized water piston pumps, whereby the pressure of the pumps can be adapted to given requirements and wear of the pumps resulting from descaling is reduced.

2. The descaling device according to claim 1, wherein a volumetric flow of pressurized water flowing through at least one of the piston pumps is adjustable.

3. The descaling device according to claim 1, wherein the piston pumps are substantially identical.

4. The descaling device according to claim 1, wherein the nozzles are arranged in a first row, further comprising a second row of nozzles in front of the first row of nozzles, wherein the first and second rows of nozzles are spaced apart from each other such that the water jets from the two rows of nozzles do not influence each other, additional pumps arranged in parallel for supplying pressurized water to the second row of nozzles, wherein the additional pumps are configured to supply pressurized water at a lower pressure than the pressure of the water supplied by the pressurized water piston pumps.

5. The descaling device according to claim 4, wherein the additional pumps are piston pumps.

6. The descaling device according to claim 4, wherein the additional pumps are centrifugal pumps.

7. A method of removing primary scale from slabs or strips in hot rolling mills, the method comprising producing a flow of pressurized water having a pressure of between 300 and 600 bars by at least two pressurized water piston pumps which are connected in parallel and are separately switchable on and off whereby the pressure of the pumps can be adapted to given requirements and wear of the pumps resulting from descaling is reduced.

* * * * *